United States Patent [19]

de Nora et al.

[11] 4,064,021

[45] Dec. 20, 1977

[54] METHOD OF IMPROVING ELECTROLYTE CIRCULATION

[75] Inventors: Vittorio de Nora, Nassau, Bahamas; Oronzio de Nora, Milan, Italy

[73] Assignee: Diamond Shamrock Technologies S.A., Geneva, Switzerland

[21] Appl. No.: 654,396

[22] Filed: Feb. 2, 1976

Related U.S. Application Data

[62] Division of Ser. No. 485,844, July 5, 1974, Pat. No. 3,956,097.

[51] Int. Cl.[2] ..... C25B 1/16; C25B 1/26

[52] U.S. Cl. ..... 204/98; 204/128

[58] Field of Search ..... 204/98, 128, 258, 266, 204/270, 278, 273

[56] References Cited

U.S. PATENT DOCUMENTS

| | | | |
|---|---|---|---|
| B 388,701 | 1/1975 | Johnson | 204/258 |
| 3,956,097 | 5/1976 | de Nora et al. | 204/252 |

*Primary Examiner*—R. L. Andrews

*Attorney, Agent, or Firm*—Hammond & Littell

[57] ABSTRACT

Provides an imperforate valve metal blanket between the cell base of a diaphragm electrolysis cell and the cell can, which acts as a conductor from the positive current leads to dimensionally stable anodes and provides hollow anodes with perforate and imperforate sections to promote anolyte circulation within the cell.

4 Claims, 8 Drawing Figures

FIG. 1
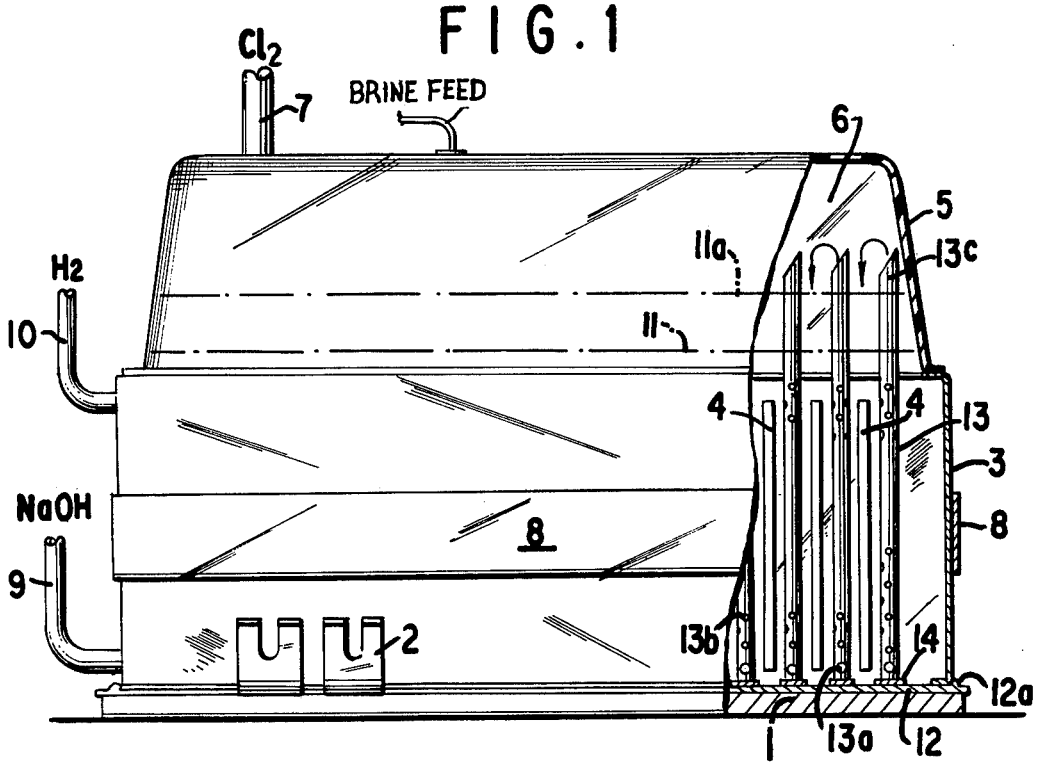
FIG. 2
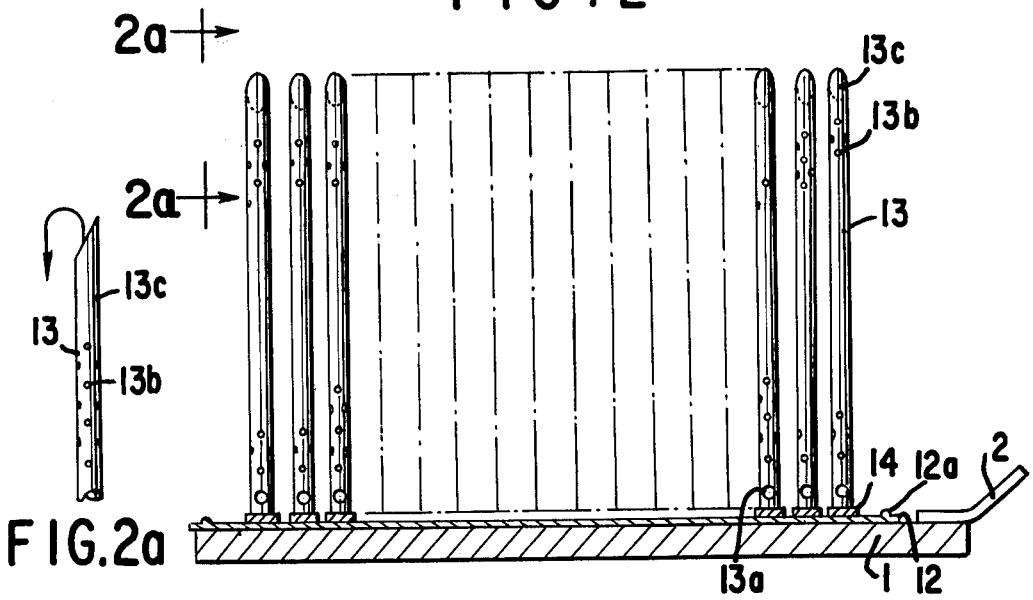
FIG. 2a

METHOD OF IMPROVING ELECTROLYTE CIRCULATION

PRIOR APPLICATION

This application is a division of our copending, commonly assigned U.S. application Ser. No. 485,844 filed July 5, 1974, now U.S. Pat. No. 3,956,097.

This invention relates to an improved cell base and anode construction for use in diaphragm-type electrolysis cells using dimensionally stable anodes.

Dimensionally stable anodes are usually a valve metal base coated or partially coated with an electrically conductive electrocatalytic coating containing a platinum group metal or an oxide of a platinum group metal. These anodes, unlike graphite anodes, do not change dimensions during the electrolysis process. Valve metals, such as titanium, tantalum, zirconium, molybdenum, niobium and tungsten, have the capacity to conduct current in the anodic direction and to resist the passage of current in the cathodic direction and are sufficiently resistant to the electrolyte and conditions within an electrolytic cell used, for example, for the production of chlorine and caustic soda, to be used as electrodes in electrolytic processes. Valve metals (also called film forming metals) when connected as an anode in an electrolyte form an oxide coating on their surfaces, in a short period of time, which seals off the metal below this coating from the corrosive conditions of the electrolyte and bars passage of current through the oxide coating. When coated or partially coated with an electrically conducting electrocatalytic coating, however, the interior of the valve metals and the coated portions continue to conduct current to the electrolyte over long periods of time without passivating.

The use of dimensionally stable metal anodes having an electrically conductive electrocatalytic coating containing platinum or platinum group metal oxides or mixed oxides on a valve metal support, in place of the graphite anodes previously used, has presented problems in the construction of diaphragm-type electrolysis cells using these dimensionally stable anodes. With graphite anodes, the cell base usually consisted of a shallow cast iron pan, housing the positive bus bars, usually copper, which conducted the current to the cell, a bonding layer of electrically conductive material, such as lead, into which the graphite anode blades projected, was in contact with the bus bars and over this bonding layer an electrically insulating layer of asphalt and a layer of concrete or other material was provided to protect the metal base and bus bars from the corrosive action of the anolyte.

Early attempts to provide a better connection between the positive bus bars leading into the base of the cell and the dimensionally stable anodes was by providing a blanket of rubber or other elastic material such as neoprene or titanium over the cell base to which the positive bus bars were connected and to provide holes through the blanket and through the cell base by which the anode risers supporting the dimensionally stable metal anodes within the cell were connected to the cell base and bus bars in such a manner as to convey current from the bus bars to the anodes with little current losses. The provision of holes through the protective non-conductive blanket of rubber, neoprene or titanium, and through the cell base has, however, presented difficulties because of the leakage of the anolyte fluid into the crevices surrounding the holes through the blanket and cell base causing corrosion of the cell base and bus bars and also problems in connection with the removal of the anodes for recoating and repair after a period of use.

One of the objects of this invention is to provide a cell base construction for diaphragm-type electrolysis cells using dimensionally stable anodes in which the blanket between the anolyte compartment and the conductive cell base is of film forming imperforate metal, such as titanium, tantalum or other valve metals which form a non-conductive surface where directly exposed to the anolyte, but which remain conductive in the interior of the blanket and the coated portions of the anodes exposed to the anolyte.

Another object of the invention is to provide a cell having a film forming imperforate titanium blanket between the cell base and the anolyte compartment, said imperforate blanket having electrically conducting and non-conducting portions with means for easily attaching and detaching the anodes in conducting relation to said blanket, or means for easily attaching the anode lead-ins in electrical conducting relation to said imperforate titanium blanket.

Another object of the invention is to provide means for easily attaching or detaching the anode risers and the anodes supported thereon from the imperforate titanium cell blanket.

Another object is to provide hollow perforated metal anodes having an electrically conductive electrocatalytic coating on the interior thereof, so that chlorine or other gases released at the anodes will rise through the interior of the hollow perforated anodes to the gas collection space at the top of the cell.

Another object of the invention is to provide hollow anodes which are perforated from near the bottom thereof to a distance some inches below the top, so as to provide a gas conducting space on the interior of the anodes and provide free flow of the anolyte into the interior of the anodes below the anolyte level and to provide an imperforate section in the anodes extending from below the lowest anolyte level to above the top of the highest anolyte level, to provide a gas lifting and circulation effect which forces liquid anolyte through the imperforate top section of the anode tubes to cause anolyte flow from below the surface of the anolyte to a point above the surface of the anolyte, whereby the anolyte fluid discharged from the top of the anodes will flow back into the upper portion of the anolyte to provide greater circulation of the anolyte.

Various other objects and advantages of the invention will appear as this description proceeds.

In the accompanying drawings which show several preferred forms of embodiment of our invention:

FIG. 1 is a perspective view of a typical diaphragm-type electrolysis cell with portions broken away to show the interior construction and operation;

FIG. 2 is a diagrammatic view, showing the imperforate titanium or other valve metal blanket and the anodes mounted thereon, with the diaphragm covered cathodes omitted;

Figure 3:
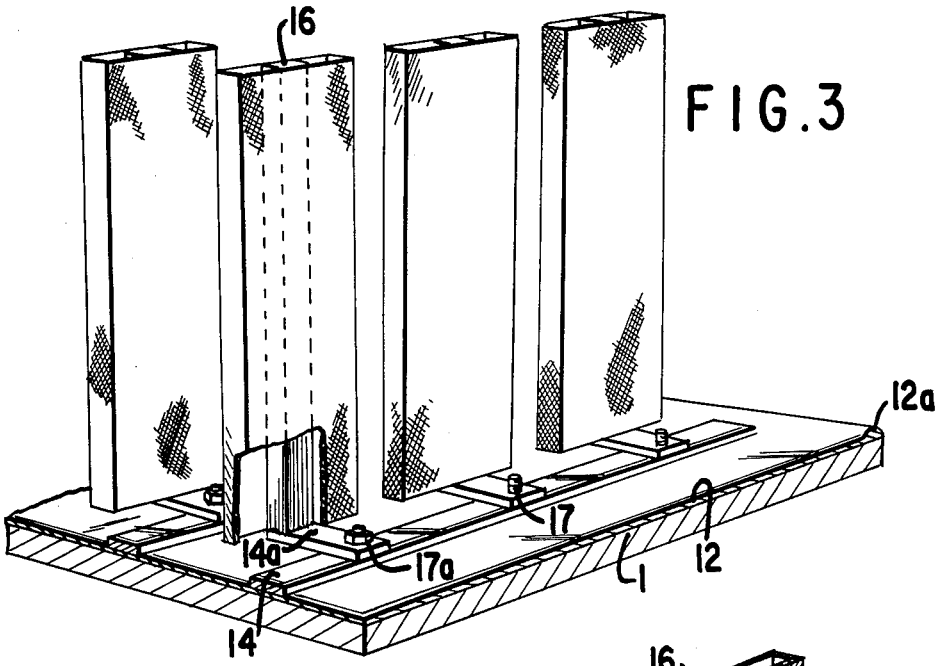
Figure 5:
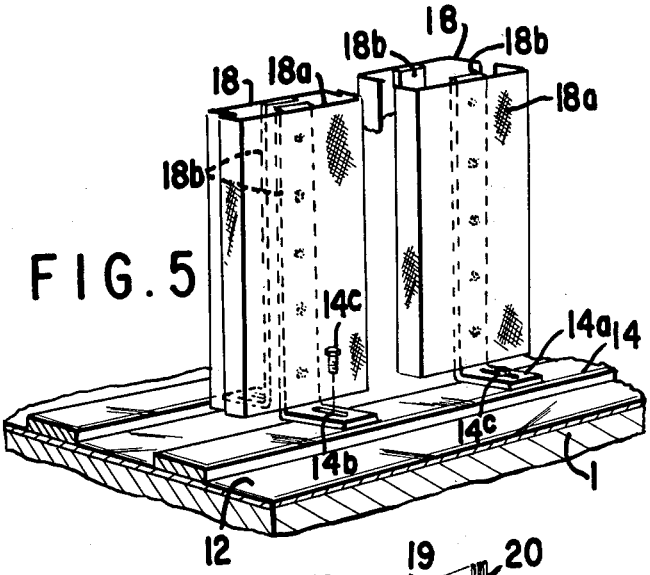
Figure 4:
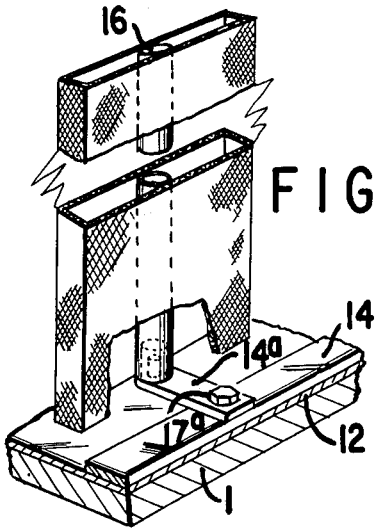
Figure 6:
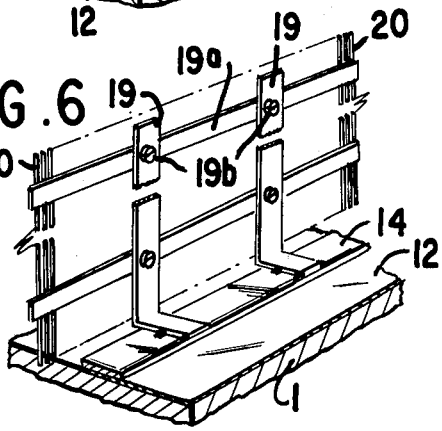
Figure 7:
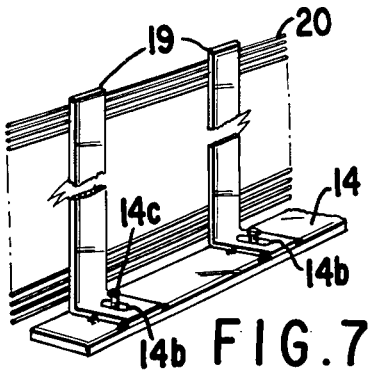

FIG. 2*a* is a side view along the line 2*a* — 2*a* of FIG. 2, showing the top of one of the anodes;

FIG. 3 is a partial perspective view showing one method of mounting chimney-shaped anodes on anode risers, which anode risers are removably mounted on the imperforate cell base;

FIG. 4 is a perspective view of another form of anode mounting;

FIG. 5 shows a further modification of the anode mounting, in which both sections of the anodes are adjustably mounted on the cell base, so that the anode sections are movable toward and away from each other and toward and away from the adjacent diaphragm covered cathodes; and FIGS. 6 and 7 show further modified forms of anode mountings.

In the following description, it will be understood that the anodes may be of hollow rectangular form mounted on the anode riser or may be hollow tubes of circular, oval, rectangular or other shapes removably or permanently mounted on the imperforate valve metal blanket. This imperforate blanket has an electrically conducting interior and non-conducting surface portions, with the anode connected to the electrically conducting portions. Generally speaking, the imperforate blanket is preferably made from a single material, such as a valve metal, preferably, titanium. However, the present invention is not to be limited to this, and includes the use of a valve metal coated imperforate blanket, or the use of a composite material in which the portion exposed to the anolyte is non-conducting and the interior portions are conducting.

A specific embodiment of titanium blanket is described herein as being non-conductive with reference to the anolyte, but current can be conducted through the interior of the titanium blanket to the anodes. The portions of the titanium blanket exposed to contact with the anolyte quickly develop a non-conductive oxide coating which is stable to the corrosive action of the anolyte liquor and non-conductive through said oxide coating while the interior of the titanium blanket still conducts current from the positive bus bars to the anodes. Titanium is preferred for the imperforate blanket, but other valve metals which develop an oxide film which is resistant to the conditions within the cell and remain conductive on their interior may be used, such as tantalum, zirconium, molybdenum, niobium and tungsten or other film forming metals or composite materials.

The invention will be described with reference to the production of chlorine and caustic soda in diaphragm electrolysis cells. It will be understood, however, that the invention may be used in the electrolysis of other halide salt solutions, and by the omission of the diaphragms between the anodes and cathodes, the apparatus may be used for the production of chlorate, hypochlorite and other electrolysis products.

As illustrated in FIG. 1, the typical diaphragm-type electrolysis cell consists of a conductive copper cell base 1 to which current lead-ins diagrammatically indicated at 2 are connected. A cell can 3 having hollow side walls into which catholyte liquor from the diaphragm covered screen cathodes 4 is discharged and flowed from the hollow side walls of the cell can to the caustic recovery system. A cell cover 5 of non-corrosive material such as a polyester resin provides a chlorine release space 6 at the top of the cell cover and an opening 7 through which chlorine gas may be withdrawn from the cell. The negative bus bars are connected to a copper band 8 which surrounds the cell can 3. Caustic liquor and depleted brine are discharged from the cell can through a typical perk tube 9 and hydrogen is discharged from the hollow walls of the cell can 3 through a hydrogen outlet 10. Cells of this general construction are shown in U.S. Pat. No. 3,491,014 to G. Bianchi et al.

In diaphragm electrolysis cells, the pores of the diaphragms gradually become plugged with deposited salts and other material, so that the porosity of the diaphragms decreases during operation of the cells. To provide the desired amount of electrolyte flow through the diaphragms, the electrolyte level is permitted to rise gradually from the level of line 11, to the level of line 11*a* as the diaphragms become less porous during use. This increases the hydrostatic head of the electrolyte and maintains the desired flow through the diaphragms as their porosity decreases.

In the embodiment of this invention illustrated in FIGS. 1 and 2, the conducting cell base 1 of copper or iron or other highly conductive metal is covered with an imperforate titanium blanket 12 provided with a beaded rim 12*a* around the outer edge of the blanket 12 and the cell can 3 with the diaphragm covered cathodes therein, rests by gravity on the top of the imperforate titanium blanket 12 with the edges of the cell can within the area enclosed by the surrounding bead 12*a*. Corrosion resistant putty or other sealing means may be used to seal the joint between the bottom of the cell can 3 and the blanket 12 so as to prevent leakage of the anolyte liquor around the base of the cell can 3.

As illustrated in FIGS. 1 and 2, hollow perforated anode tubes 13 are mounted on titanium strips 14 integral with the blanket 12, so that current conducted through the cell base 1 and the interior of the titanium blanket 12 is conducted to the anode tubes 13 and through the conductive electrocatalytic coating on the inside or outside of the tubes 13 to the electrolyte contained in the cell can 3. The tubes 13 may be permanently or removably mounted on the titanium strips 14 in any suitable manner, as by welding, or detachable connections, examples of which will be described below. Toward the bottom, tubes 13 are provided with large holes 13*a* through which anolyte from the interior of the cell can 3 can flow into the bottom of the tubes and with smaller holes 13*b* through which anolyte liquor may also flow and toward the top, imperforate sections 13*c* are provided so that the gases rising through the interior of the tubes 13 forces the anolyte in the tubes out through the imperforate top portions 13*c*, to provide an electrolyte flow leading from below the lower electrolyte level 11 in the cell can to above the upper electrolyte level 11*a*, as indicated by the arrows in FIGS. 1 and 2*a*.

FIGS. 3 and 4 illustrate hollow perforated rectangular anodes 15, preferably provided with an electrically conductive electrocatalytic coating on their interior walls and mounted on risers 16 to which the sides of the anodes 15 are preferably welded. The risers 16 may be of titanium or of copper-cored round or square titanium tubes and the risers 16 are detachably mounted on extension brackets 14*a* by welding or otherwise secured to the titanium strips 14. In FIG. 3, the risers 16 are welded on brackets 14*a* which are detachably connected to strips 14 by means of bolts and nuts 17 and 17*a* or in any other suitable manner. In FIG. 4, the risers 16 are detachably connected to the brackets 14*a* by friction welds or by bolting and the brackets 14*a* are detachably secured to the titanium strips 14.

When it is necessary to remove the anodes 15 from the cell for reapplying a conductive electrolytic coating thereon, or for repairs or other reasons, bolts 17 provided with nuts 17*a* are unloosened and the anodes 15 and risers 16 removed from the base of the cell and new or repaired and recoated anodes installed in their place.

During this operation, the cell can 3 carrying diaphragm covered cathodes 4 is raised from the cell base so as to expose the cell base 1, anodes 15, etc.

FIg. 5 illustrated a further modification in which the anodes 18 and 18*a* are adjustably secured to the titanium strips 14 by means of extension brackets 14*a* which are provided with elongated slots 14*b* and are detachably secured to the strips 14 by screws 14*c*. In this embodiment, either anode 18 or 18*a* may be moved toward and away from the adjacent cathode 4 and secured in the desired position by loosening screws 14*c*, moving the anode as desired, and retightening screws 14*c*. Anode risers 18*b* are preferably welded to the faces of anodes 18 and 18*a*, and anodes 18 and 18*a* may be provided with an electrically conductive electrocatalytic coating on either the inside or the outside faces, or both.

The preferred electrically conductive electrocatalytic coating contains a platinum group metal oxide and may contain one or more additional oxides as described in U.S. Pat. Nos. 3,632,498 and 3,711,385.

In the embodiment illustrated in FIG. 6, anode risers 19 are removably or permanently secured to the titanium strips 14 on the titanium blanket 12 and are provided with horizontal cross bars 19*a* which may be removably or permanently secured on the risers 19 by means of bolt connections 19*b*. The vertical rod anodes 20 are welded to the cross bars 19*a*. The cross bars 19*a* may be removed from the risers 19 after the cell can 3 has been lifted from the titanium blanket 12, when it becomes necessary to recoat or repair the anodes 20.

In the embodiment illustrated in FIG. 7, the anode rods 20 are secured directly upon the anode risers 19 and the anode risers 19 may be removably or permanently secured to the strips 14 by means of elongated slots 14*b* and screws 14*c*, so that the anodes of FIG. 7 may be removed from the blanket 12 for recoating or repair and so that the anodes 20 may be moved toward and away from the adjacent cathode surface by the adjustment provided by the elongated slots 14*b* and screws 14*c*. Any holes provided in strips 14 for the connection and disconnection of the anodes extend only a short distance into the titanium blanket, so that there are no holes going entirely through the blanket 12. The strips 14 may be formed integrally with the blanket 12 or formed separate from the blanket and welded thereon, and the blanket 12 may be welded to the copper cell base 1 or to a ferrous metal cell base, into which the copper bus bars 2 extend, using an intermediate layer of copper between the titanium blanket and the ferrous metal cell base, if necessary.

If desired, the anode risers 16, 18*b* and 19 and the supporting structure therefor may be turned 90° from the position illustrated in FIGS. 3 to 7, so that the anode faces extend horizontally between the cathodes 4 instead of vertically as illustrated, and it will be understood that other modifications and changes may be made from the embodiments illustrated and described herein without departing from the spirit of this invention or the scope of the following claims.

What is claimed is:

1. The method of providing circulation of the anolyte in an electrolysis cell having an electrode gap formed between dimensionally stable tubular vertical anodes provided with perforations throughout the section of their height in the electrode gap facing the cathodes and an imperforate portion near the top of the anodes and dimensionally stable vertical cathodes, which comprises applying an electrically conductive electrocatalytic coating on the inside of the said tubular anodes and using the gas lifting effect of gas generated on the inside of said tubular anodes to circulate anolyte through said imperforate portion of the anodes and into the top level of the anolyte.

2. The method of improving recirculation of the electrolyte in an electrolysis cell having dimensionally stable vertical anodes and cathodes therein forming an electrodic gap therebetween, and wherein gas is evolved at the anode during electrolysis of an electrolyte in the cell, which comprises utilizing a hollow anode structure open at the top, perforated throughout the section of their height which faces the cathodes in the electronic gap and beyond which the remaining section rises is imperforate and is of sufficient length to exploit the upward thrust imparted to the electrolyte contained within the hollow anode structure by the gas bubbles which form on the anode surface, to generate a recirculation motion in the electrolyte contained in the cell.

3. The method of claim 2 wherein the anodes are provided with an electrically conductive, electrocatalytic coating in the inside of the perforate section of the anodes whereby the gas is generated in the interior of the anode.

4. The method of claim 2 wherein the anodes are tubular.

* * * * *